US009435577B2

(12) United States Patent
Gu et al.

(10) Patent No.: US 9,435,577 B2
(45) Date of Patent: Sep. 6, 2016

(54) COOLING APPLIANCE AND OPERATION METHOD THEREOF

(71) Applicant: BSH BOSCH UND SIEMENS HAUSGERÄTE GMBH, Munich (DE)

(72) Inventors: Tao Gu, Nanjing (CN); Jiangbo Keong Sun, Nanjing (CN); Jun Xia, Nanjing (CN); Kai Xu, Giengen (DE)

(73) Assignee: BSH HAUSGERÄTE GMBH, Munich (DE)

( * ) Notice: Subject to any disclaimer, the term of this patent is extended or adjusted under 35 U.S.C. 154(b) by 169 days.

(21) Appl. No.: 14/350,509

(22) PCT Filed: Oct. 4, 2012

(86) PCT No.: PCT/IB2012/055338

§ 371 (c)(1),
(2) Date: Apr. 8, 2014

(87) PCT Pub. No.: WO2013/054239

PCT Pub. Date: Apr. 18, 2013

(65) Prior Publication Data

US 2014/0245758 A1 Sep. 4, 2014

(30) Foreign Application Priority Data

Oct. 14, 2011 (CN) ..... 2011 1 0321158

(51) Int. Cl.
*F25B 5/00* (2006.01)
*F25D 11/00* (2006.01)
(Continued)

(52) U.S. Cl.
CPC ..... *F25D 11/00* (2013.01); *F25D 29/00* (2013.01); *F25D 11/022* (2013.01); *F25D 2400/361* (2013.01); *F25D 2700/12* (2013.01)

(58) Field of Classification Search
CPC .... F25D 23/003; F25D 23/061; F25D 19/02; F25D 19/00
USPC ..... 62/56, 125, 440, 117, 449
See application file for complete search history.

(56) References Cited

U.S. PATENT DOCUMENTS 4,014,178 A * 3/1977 Kells ..... F25D 29/005 62/125
4,148,194 A 4/1979 Kells
(Continued)

FOREIGN PATENT DOCUMENTS

DE 20 2009 006295 7/2010
EP 0 192 526 8/1986
(Continued)

OTHER PUBLICATIONS

International Search Report issued for PCT/IB2012/055338, mailed Jul. 4, 2013.
(Continued)

*Primary Examiner* — Melvin Jones
(74) *Attorney, Agent, or Firm* — Nixon & Vanderhye P.C.

(57) ABSTRACT

The present invention relates to a cooling appliance and an operating method thereof. The cooling appliance comprises multiple thermally insulated storage chambers (2, 3, 4), a cooling system (5) for cooling these storage chambers (2, 3, 4), and an indication unit (20). According to the proposal of the present invention, the indication unit (20) is set to be capable of displaying information about which of the storage chambers (2, 3, 4) is/are being cooled by the cooling system (5).

18 Claims, 3 Drawing Sheets

(51) Int. Cl.
*F25D 29/00* (2006.01)
*F25D 11/02* (2006.01)

(56) References Cited

U.S. PATENT DOCUMENTS

| | | | |
|---|---|---|---|
| 4,966,004 | A | 10/1990 | Midlang et al. |
| 6,408,634 | B1 | 6/2002 | Choi |
| 2002/0011072 | A1 | 1/2002 | Hiraoka et al. |
| 2009/0103587 | A1 | 4/2009 | Cooper et al. |
| 2010/0287963 | A1 | 11/2010 | Billen et al. |
| 2011/0000242 | A1 | 1/2011 | Probst et al. |

FOREIGN PATENT DOCUMENTS

| | | |
|---|---|---|
| EP | 0 383 222 | 8/1990 |
| FR | 2 873 431 | 1/2006 |
| JP | 2002-071256 | 3/2002 |

OTHER PUBLICATIONS

Written Opinion of the International Searching Authority PCT/IB2012/055338, mailed Jul. 4, 2013.

* cited by examiner

COOLING APPLIANCE AND OPERATION METHOD THEREOF

This application is the U.S. national phase of International Application No. PCT/IB2012/055338, filed 4 Oct. 2012, which designated the U.S. and claims priority to China Application No. 201110321158.5, filed 14 Oct. 2011, the entire contents of each of which are hereby incorporated by reference.

TECHNICAL FIELD

The present invention relates to a cooling appliance and an operation method thereof, in particular to a cooling appliance having multiple thermally insulated storage chambers and a cooling system for cooling the storage chambers, and an operation method thereof.

BACKGROUND ART

Cooling appliances having multiple storage chambers and a cooling system for cooling these storage chambers are already well-known in the prior art, examples being commercially available two-door refrigerators, three-door refrigerators and French door refrigerators, etc. The different storage chambers of these refrigerators are generally controlled by different temperature controllers, and when the cooling system is operating, not all of the storage chambers are cooled at the same time; for example, when the cooling system is in chilled compartment mode, the chilled compartment is cooled, whereas when it is necessary to cool the freezer compartment, the cooling system is in freezer compartment mode, and the freezer compartment is cooled.

Solutions for indicating certain information about the cooling system to a user have appeared in the prior art. For example, Chinese patent CN1833148B discloses a refrigerator in which the rotational speed state of a compressor with variable rotation speed (low rotation speed, medium rotation speed or high rotation speed) is displayed on the front of the main refrigerator body. Another example is CN91207355.1, which discloses a refrigerator dual-circuit temperature displayer capable of displaying the operating state of a compressor (whether it is operating or has stopped operating).

CONTENT OF THE INVENTION

An object of the present invention is to provide a cooling appliance which allows a user to have a fuller understanding of the operating state thereof.

In view of this, one aspect of the present invention relates to a cooling appliance, comprising a plurality of thermally insulated storage chambers, a cooling system for cooling these storage chambers, and an indication unit, characterized in that the indication unit is configured to be capable of displaying information about which of the storage chambers is/are being cooled by the cooling system.

As a result, the user can find out which of the storage chambers is/are currently being cooled by the cooling appliance; the user gains a fuller understanding of the operating state of the cooling appliance, and the cooling appliance appears more user-friendly.

Other single features, or features which are considered to be characteristic of the present invention when combined with other features, will be expounded in the claims appended below.

According to a preferred embodiment of the present invention, the information is displayed by way of characters, symbols, optical and/or acoustic signals.

According to a preferred embodiment of the present invention, the indication unit comprises at least one indication portion, and indicates the information by way of a pre-determined state of the indication portion.

According to a preferred embodiment of the present invention, the indication unit comprises multiple indication portions corresponding to one or more storage chambers respectively, each indication portion indicating, by way of a pre-determined state, information that one or more corresponding storage chambers is/are being cooled.

According to a preferred embodiment of the present invention, it comprises illumination elements for illuminating corresponding indication portions, and the pre-determined state comprises the indication portions being illuminated by the corresponding illumination elements, the luminance of the indication portions changing, and/or the indication portions presenting a pre-determined color.

According to a preferred embodiment of the present invention, when a storage chamber is being cooled, the luminance of the illumination element corresponding to the storage chamber periodically and gradually changes between a lower limit value and an upper limit value. The dynamically changing luminance facilitates understanding of the information represented thereby that "the corresponding storage chamber is being cooled".

According to a preferred embodiment of the present invention, the multiple indication portions are sequentially arranged according to an arrangement order of the storage chambers. This assists the user greatly in understanding the correspondence relationship between the indication portions and the various storage chambers, so that a description of the indication portions by characters or symbols could be expected to be omitted.

According to a preferred embodiment of the present invention, the cooling appliance comprises multiple doors, each door being used to close or open a corresponding storage chamber, and the indication unit being disposed on the front side of at least one door. This results in the indication unit being more intuitive.

According to a preferred embodiment of the present invention, the indication unit is disposed on one of these doors. As a result, only one door needs to be modified (for instance to install the indication unit, supply electricity and transmit signals to the indication unit, etc.); in other words, the indication unit can be provided while satisfying the precondition that an existing cooling appliance should not need to be made significantly more complex.

In an alternative embodiment, each indication portion is disposed on the door of the storage chamber corresponding thereto. This results in the correspondence relationship between the indication portions and the storage chambers to which they correspond being more obvious, and very easily understood by the user.

According to a preferred embodiment of the present invention, it comprises a main display unit for displaying at least one set parameter of the cooling appliance, the indication unit and the main display unit being separately disposed. This results in the indication function of the indication unit being particularly prominent.

Preferably, when the multiple storage chambers are closed, the main display unit is not visible when the viewing direction is from the front of the cooling appliance, while the indication unit is visible.

In an alternative embodiment, the indication unit can be integrated in the main display unit. For example, information about the operation of the cooling system can be expressed by having the main display unit display relevant characters and/or symbols. Using this method makes it possible to obtain the indication unit without needing to significantly alter the hardware structure of an existing cooling appliance.

Another aspect of the present invention relates to an operation method of a cooling appliance, wherein the cooling appliance comprises multiple storage chambers and a cooling system for cooling these storage chambers. It is characterized in that the method comprises: determining which of the storage chambers is/are being cooled by the cooling system; displaying, by way of an indication unit, information about which of the storage chambers is/are being cooled by the cooling system.

According to a preferred embodiment of the present invention, the step of determining which of the storage chambers is/are being cooled by the cooling system comprises: detecting the temperature of each storage chamber, and judging whether or not the storage chamber temperature obtained is falling; if it is, then determining that the cooling system is cooling this or these chamber(s) with falling temperature.

According to a preferred embodiment of the present invention, the cooling system comprises at least one valve for changing the cooling mode of the cooling system; the position of the valve is determined in order to judge which of the storage chambers is/are being cooled by the cooling system.

According to a preferred embodiment of the present invention, the indication unit comprises multiple illumination elements, each illumination element corresponding to at least one storage chamber, and in the step of displaying, by way of the indication unit, information about which of the storage chambers is/are being cooled by the cooling system, the luminance of the illumination element corresponding to the storage chamber periodically and gradually changes between a lower limit value and an upper limit value.

The structure of the present invention, and other inventive objects and beneficial effects thereof, will be made more obvious and comprehensible by describing preferred embodiments with reference to the accompanying drawings.

DESCRIPTION OF THE ACCOMPANYING DRAWINGS

Serving as part of this specification, the following accompanying drawings illustrate particular embodiments of the present invention and are intended to explain the principles thereof together with the specification.

PARTICULAR EMBODIMENTS

Figure 1:
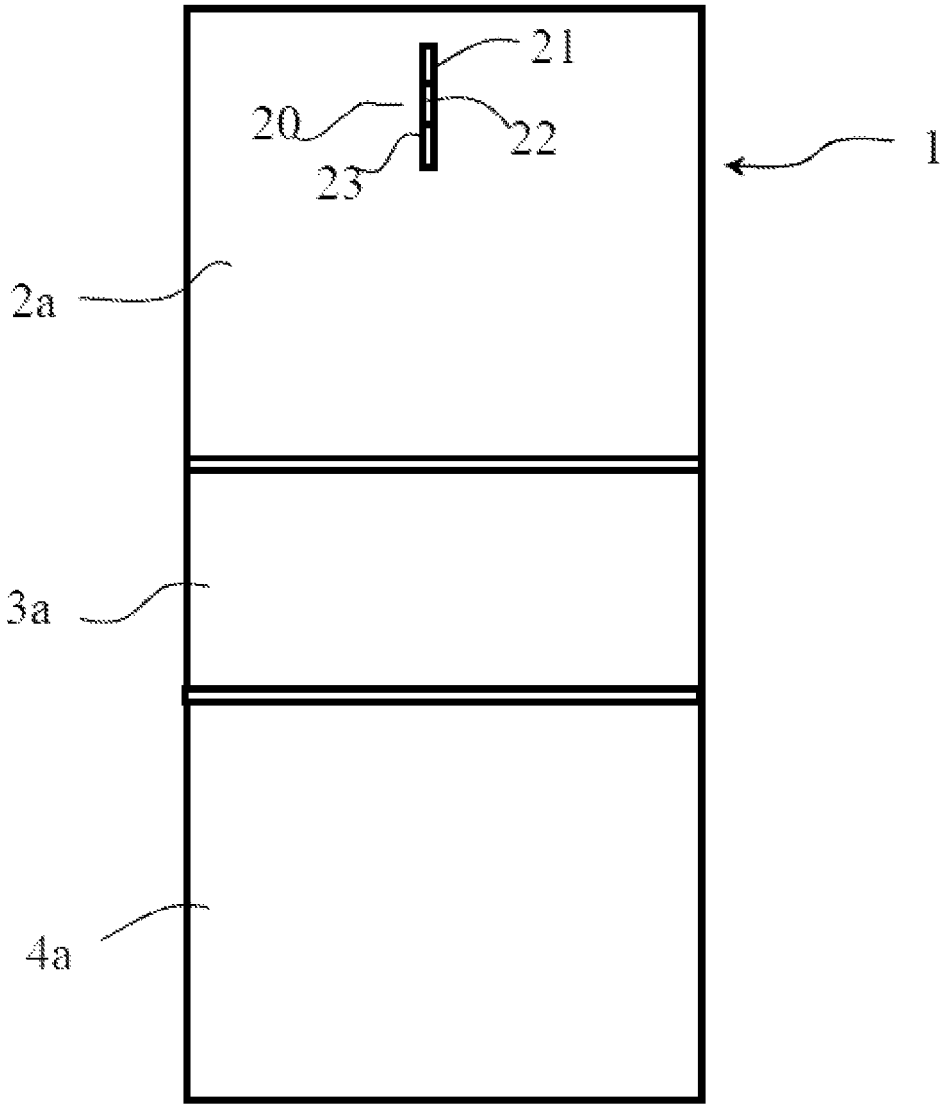
FIG. 1 is a schematic front view of a cooling appliance according to a preferred embodiment of the present invention.
Figure 2:
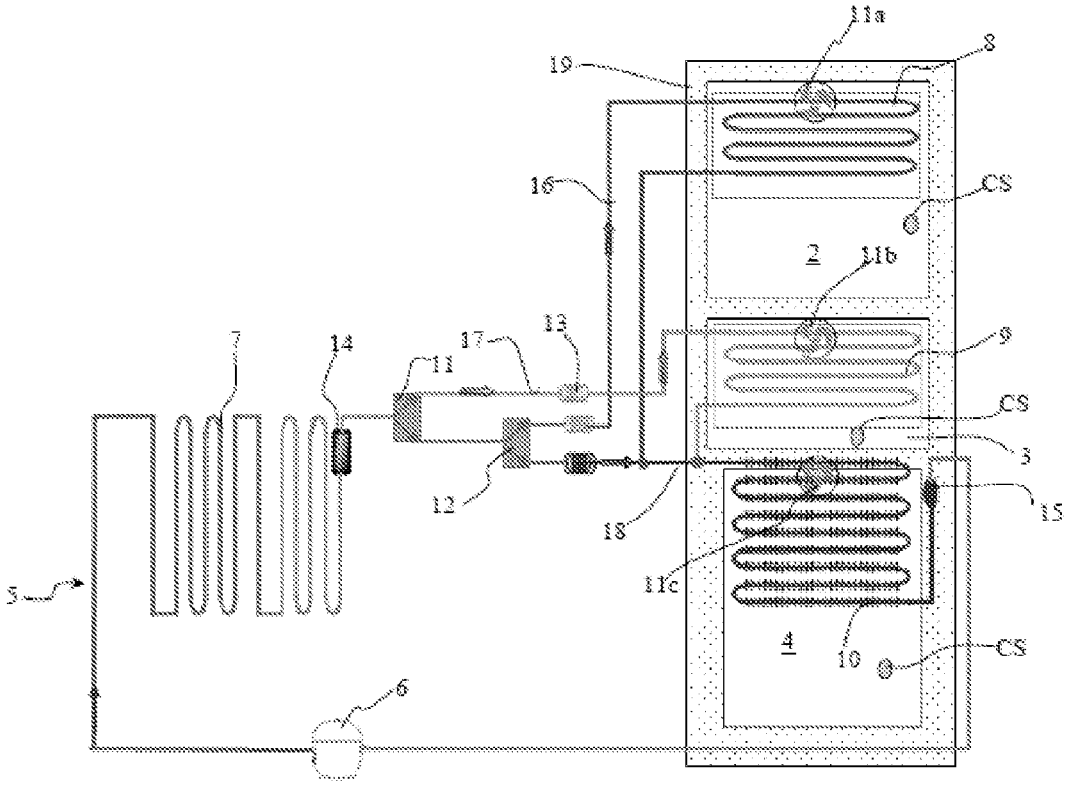
FIG. 2 is a schematic diagram of the structure and cooling system of a cooling appliance according to a preferred embodiment of the present invention.

Please refer to the accompanying drawings; first, please refer in particular to FIG. 1 and FIG. 2. A cooling appliance 1 comprises multiple thermally insulated storage chambers 2, 3 and 4, and doors 2*a*, 3*a* and 4*a* for closing or opening the corresponding storage chambers separately. In this embodiment, the cooling appliance 1 comprises three thermally insulated storage chambers, comprising a chilled compartment 2 located at the top of the cooling appliance 1, a freezer compartment 4 located at the bottom, and a controlled freezing-point compartment 3 located between these two. It should be understood that this is merely an example, and the present invention should not be restricted by the specific construction of the cooling appliance (such factors as the number of storage chambers and their relative positions); for instance, the present invention could be applied to a refrigerator comprising two storage chambers, or a greater number of storage chambers. Obviously, the present invention could also be applied to such cooling devices as wine coolers and freezer cabinets.

The cooling appliance 1 comprises a cooling system 5 for cooling the storage chambers 2, 3 and 4. In this embodiment, the cooling system 5 is a compressor-type cooling system, comprising a compressor 6, a condenser 7 and multiple evaporators 8, 9 and 10 connected after the condenser 7. In this embodiment, the cooling system 5 comprises a first evaporator 8 for cooling the chilled compartment 2, a second evaporator 9 for cooling the controlled freezing-point compartment 3, and a third evaporator 10 for cooling the freezer compartment 4. Capillary tubes 13 are connected in front of the inlets of the evaporators 8, 9 and 10. Corresponding fans 11*a*, 11*b* and 11*c* can also be provided inside the storage chambers 2, 3 and 4.

The cooling system 5 may also comprise a drier 14 located between the condenser 7 and a first valve 11. A liquid reservoir 15 can be provided between the outlet side of the third evaporator 10 and the inlet of the compressor 6.

The inlet ends of the first, second and third evaporators 8, 9 and 10 are connected in parallel, with the result that the cooling system 5 comprises a first branch 16 with the first evaporator 8, a second branch 17 with the second evaporator 9, and a third branch 18 with the third evaporator 10. Those ends of and the first branch 16 and the second branch 17 which are connected to the outlets of the corresponding evaporators 8 and 9 are connected to that pipeline section of the third branch 18 which is connected to the inlet of the third evaporator 10.

After being compressed by the compressor 6, refrigerant enters the condenser 7 and is condensed to dissipate heat. The refrigerant exiting the condenser 7 can optionally enter different branches so as to cool different storage chambers. The direction of flow of the refrigerant exiting the condenser 7 is decided by a first solenoid valve 11 and a second solenoid valve 12. It should be understood that it is possible to use only one valve to open different branches.

Figure 3:
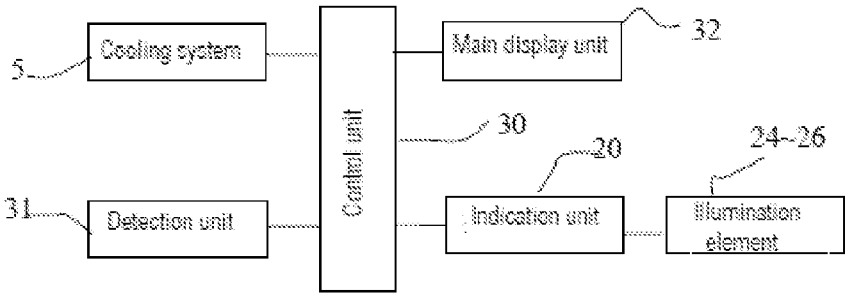
FIG. 3 is a structural schematic diagram of a cooling system according to a preferred embodiment of the present invention.

Please refer to FIG. 3; the cooling appliance 1 comprises a control unit 30 associated with the operation of the cooling system 5. The cooling system 5 operates according to the instructions of the control unit 30; for example, the first and second solenoid valves 11 and 12, the compressor 6 and the fans 11*a*-11*c* operate according to the instructions of the control unit 30.

The cooling appliance comprises a detection unit 31 associated with the operation of the control unit 30. The detection unit 31 comprises temperature sensors CS located within corresponding storage chambers 2, 3 and 4, so as to detect the temperature of each of the storage chambers 2, 3 and 4.

Based on signals from the detection unit 31, the control unit 30 controls the state of the compressor 6 and the positions of the first solenoid valve 11 and the second solenoid valve 12 so as to open corresponding branches, such that the refrigerant evaporates inside at least one of the corresponding evaporators 8, 9 and 10 and thus cools the corresponding storage chamber.

As FIG. 2 shows, when the first branch 16 is open, the cooling appliance is in chilled compartment cooling mode. Refrigerant exiting the condenser 7 flows towards the first evaporator 8 after expanding by passing through the corresponding capillary tube 13, and evaporates inside the first evaporator 8, absorbing heat and hence cooling the chilled compartment 2. After flowing out of the first evaporator 8, the refrigerant flows towards the third branch 18 and through the third evaporator 10. The refrigerant subsequently flows towards the compressor 6 after flowing out of the third evaporator 10.

Similarly, when the second branch 17 is open, the cooling appliance 1 is in controlled freezing-point compartment cooling mode. Refrigerant exiting the condenser 7 flows towards the second evaporator 9 first after expanding by passing through the corresponding capillary tube 13, and evaporates inside the second evaporator 9, absorbing heat and hence cooling the controlled freezing-point compartment 3. After flowing out of the second evaporator 9, the refrigerant flows towards the third branch 18 and through the third evaporator 10. The refrigerant subsequently flows towards the compressor 6 after flowing out of the third evaporator 10.

When the third branch 18 is open, the cooling appliance 1 is in freezer compartment cooling mode. Refrigerant exiting the condenser 7 flows towards the third evaporator 10 first after expanding by passing through the corresponding capillary tube 13, and evaporates inside the third evaporator 10, absorbing heat and hence cooling the freezer compartment 4. The refrigerant flows towards the compressor 6 after flowing out of the third evaporator 10.

In an alternative embodiment, in the chilled compartment cooling mode and the controlled freezing-point compartment cooling mode, it is also possible that the refrigerant does not flow through the third branch 18 after flowing out of the first or the second evaporator, but flows towards the compressor 6 directly as in the freezer compartment mode.

The cooling appliance 1 comprises an indication unit 20 for indication information about which of the storage chambers is/are being cooled.

In the embodiment shown in FIG. 2, each of the storage chambers 2, 3 and 4 is separately cooled by its respective evaporator; in each of the cooling modes, one of the corresponding storage chambers 2, 3 and 4 is cooled. This means that the indication unit 20 only displays information that one storage chamber is being cooled in one period of time. It should be understood that the present invention is not limited to this. In another alternative embodiment, in one cooling mode (one cooling cycle), some or all of the multiple storage chambers can be simultaneously cooled by one or more evaporators; thus the indication unit 20 can also display multiple storage chambers that are being simultaneously cooled.

Figure 4:
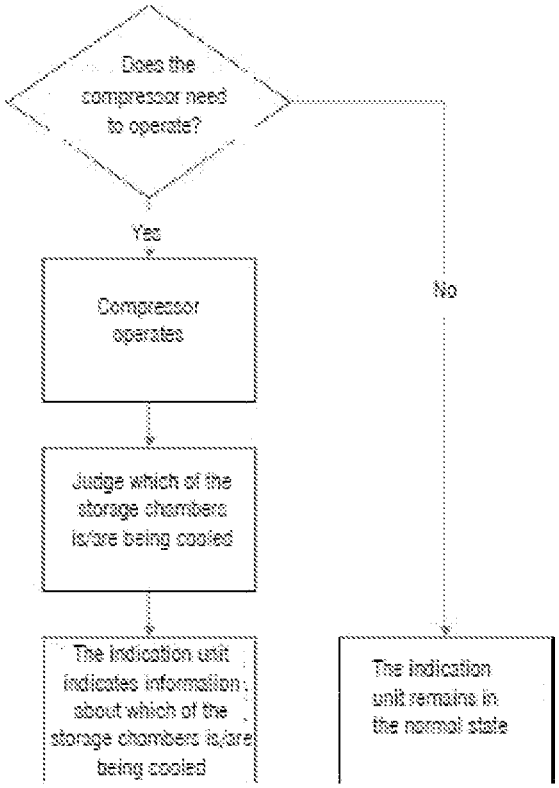
FIG. 4 is an operation method related to indicating the operating state of a cooling system according to a preferred embodiment of the present invention.

FIG. 4 shows an operation method of a cooling system according to a preferred embodiment of the present invention. A method for displaying the cooling operating state of the cooling system 5 according to a preferred embodiment of the present invention is described in detail below with reference to FIG. 2, FIG. 3 and FIG. 4.

First, the control unit 30 judges whether or not the compressor 6 needs to be started. The control unit 30 can determine this using feedback from the detection unit 31 regarding whether or not the temperature of each of the storage chambers 2, 3 and 4 has reached or exceeded a certain upper limit. If the temperature inside one or more of the storage chambers 2, 3 and 4 has reached the corresponding preset upper limit, the cooling system 5 is made to operate by starting the compressor 6.

When the compressor 6 is operating, a judgment is made on which of the storage chambers is/are being cooled by the cooling system 5. This can be judged by the positions of the first solenoid valve 11 and the second solenoid valve 12. In an alternative embodiment, the control unit 30 can also directly use the temperature detected by temperature sensors located in the storage chambers to judge whether or not the corresponding storage chambers are in the state of being cooled. For example, when the detection unit 31 detects that the temperature of one or more storage chambers is falling, this indicates that the one or more storage chambers is/are in the state of being cooled by the cooling system.

If the chilled compartment 2 is being cooled, i.e. the cooling system 5 is in the chilled compartment cooling mode, refrigerant flows into the first evaporator 8 and evaporates to cool the chilled compartment 2; the control unit 30 transfers this information to the indication unit 20, and the information displayed by the indication unit 20 will indicate that the chilled compartment 2 is being cooled.

If the controlled freezing-point compartment 3 is being cooled, i.e. the cooling system 5 is in the controlled freezing-point compartment cooling mode, refrigerant evaporates in the second evaporator 9 to cool the controlled freezing-point compartment 3; the control unit 30 transfers this information to the indication unit 20, and the information displayed by the indication unit 20 indicates that the controlled freezing-point compartment 3 is being cooled.

Similarly, if the cooling system 5 is in the freezer compartment cooling mode, i.e. refrigerant flows into the third branch 18 and evaporates in the third evaporator 10 to cool the freezer compartment 4, the control unit 30 transfers this information to the indication unit 20, and the information displayed by the indication unit 20 indicates that the freezer compartment 4 is being cooled.

Preferably, the indication unit 20 can continuously display which of the storage chambers is/are being cooled, until the cooling system 5 stops operating to cool this or these storage chambers.

The indication unit 20 can display information that one or more storage chambers is/are being cooled by such means as characters, symbols, optical and/or acoustic signals.

According to the embodiment shown in FIG. 1, the indication unit 20 displays information relating to which of the storage chambers is/are being cooled by way of optical signals. The indication unit 20 can be disposed on the front side of one or more doors of the cooling appliance 1.

The indication unit 20 and a main display unit 32 for displaying at least one set parameter of the cooling appliance 1 are separately disposed. For example, the main display unit 32 is disposed on a casing 19 of the cooling appliance 1 (such as a front end of an upper wall of the casing 19) and the user can only see the main display unit 32 when a corresponding door is opened.

In the embodiment shown in FIG. 1, the indication unit 20 is disposed on the door 2*a* used to close the chilled compartment 2. The indication unit 20 comprises multiple indication portions 21, 22 and 23, each corresponding to one storage chamber. The indication portions 21, 22 and 23 are transparent, and may be formed from a front panel of the chilled compartment 2*a* directly, or formed by a component mounted on the front panel.

The indication portions 21, 22 and 23 may be in the shape of a strip as shown in FIG. 1; of course, the indication portions 21, 22 and 23 may also have other shapes.

The indication portions 21, 22 and 23 are sequentially arranged according to the arrangement order of the storage chambers 2, 3 and 4. In the embodiments shown in FIG. 1 and FIG. 2, the different indication portions 21, 22 and 23 are sequentially arranged in a longitudinal direction; that is to say, the first indication portion 21 for indicating whether or not the chilled compartment 2 is in the state of being cooled is located at the top; the third indication portion 23 for indicating whether or not the freezer compartment 4 is in the state of being cooled is located at the bottom; and the second indication portion 22 for indicating whether or not the controlled freezing-point compartment 3 is in the state of being cooled is located between the first and second indication portions 21 and 23. In an alternative embodiment, an arrangement of these indication portions in the horizontal direction or another direction is also a sequential arrangement in accordance with the arrangement order of the storage chambers.

In an alternative embodiment, it is also possible for each indication portion to be disposed on the door of the storage chamber corresponding thereto; for example, the different indication portions corresponding to the chilled compartment, the controlled freezing-point compartment and the freezer compartment are disposed on the chilled compartment door 2*a*, the controlled freezing-point compartment 3*a* and the freezer compartment 4*a* respectively.

The indication unit 20 comprises multiple illumination elements 24, 25 and 26 corresponding to the indication portions 21, 22 and 23 respectively. The illumination elements 24, 25 and 26 can be LED lamps.

Each of the illumination elements 24, 25 and 26 is used to illuminate the corresponding indication portion 21, 22 or 23. By means of a pre-determined state of the illumination elements 24, 25 and 26, the indication portions 21, 22 and 23 are made to present a pre-determined state to indicate that the corresponding storage chambers 2, 3 and 4 are being cooled. For example, the indication portions 21, 22 and 23 can be brought into a pre-determined state (such as being illuminated, having a changing luminance, and/or presenting a pre-determined color) by having the illumination elements 24, 25 and 26 energized, having the luminance of the illumination elements 24, 25 and 26 change, and/or having the illumination elements 24, 25 and 26 lit up with a pre-determined color, in order to display information that the storage chambers 2, 3 and 4 corresponding to the indication portions 21, 22 and 23 are being cooled.

Figure 5:
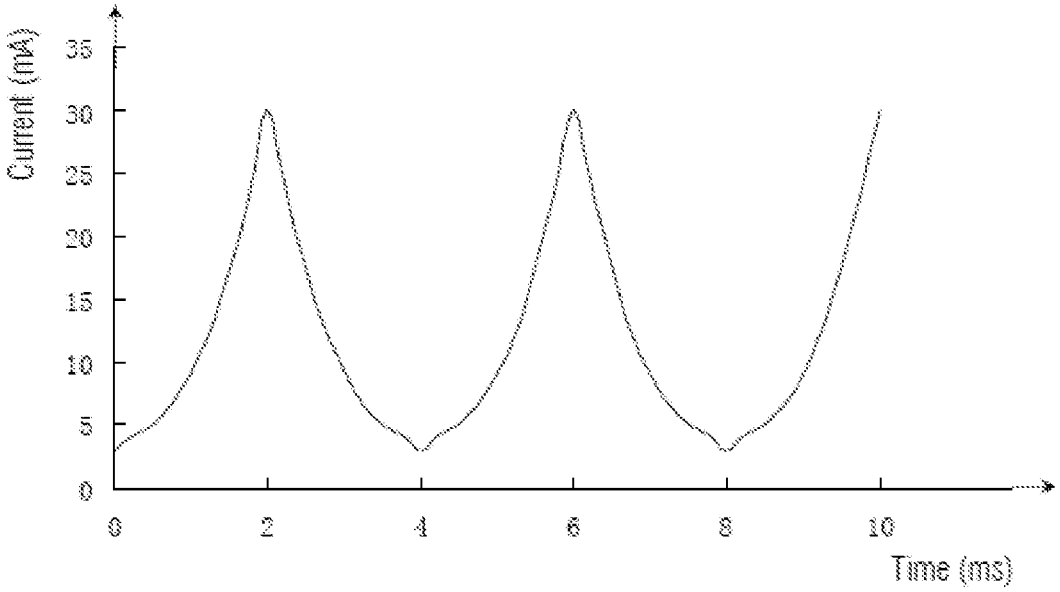
FIG. 5 is a schematic diagram of the electric current of an illumination element according to a preferred embodiment of the present invention.

FIG. 5 shows a schematic diagram of the electric current of an illumination element according to a preferred embodiment of the present invention when in an indicating state. As shown in FIG. 5, when it is necessary to indicate that one storage chamber is in the state of being cooled, i.e. when the illumination element corresponding to that storage chamber is in the indicating state, the current value of the illumination element changes continuously; this makes the luminance of the illumination element and the indication portion illuminated by the illumination element change continuously, thereby indicating to the user that the compressor of the cooling system is operating and cooling the storage chamber.

In a preferred embodiment, the luminance of the illumination element may be adjusted by way of a PWM driving signal. For example, when in the normal state, i.e. when the storage chamber is not being cooled by the cooling system, the illumination element corresponding to the storage chamber may be in a low-brightness state (for example, the PWM driving signal having a duty cycle of 10%), at which time the current of the illumination element (for example, the current value corresponding to time t=0 in FIG. 5) is at a minimum.

When the storage chamber is in the cooling state, the luminance of the illumination element corresponding to the storage chamber gradually changes from the low-brightness state (for example, the PWM driving signal having a duty cycle of 10%) to a high-brightness state (for example, the PWM driving signal having a duty cycle of 100%), and the current reaches a maximum value (such as the current value corresponding to time t=2 s in FIG. 5). After reaching the high-brightness state, it gradually returns to the low-brightness state. During this process, the luminance of the indication portion also gradually changes from low brightness to high brightness, then from high brightness to low brightness, and repeats this cycle until cooling of the storage chamber ends. As a result, the indication portion indicates information that the storage chamber corresponding thereto is being cooled by way of a state in which it appears to be "breathing".

Each "breathing" period of the illumination element can be 4 seconds. During the gradual changing, the current value of the illumination element can be a curve with downward depressions as shown in FIG. 5.

In an alternative embodiment, it is also possible that the illumination element is not energized when in the normal state, only being energized when in the indicating state.

Furthermore, in the above embodiments, the states of all the storage chambers can be indicated by the indication unit. However, in an alternative embodiment, it is also possible that the state of only one or a few storage chambers can be indicated by the indication unit, and this should also fall within the scope of protection of the claims of the present invention.

In addition, in the embodiment shown in FIG. 2, the cooling system 1 is a single-compressor cooling circuit having multiple loops. It should be understood that the present invention should not be limited to this. For example, in other embodiments, the cooling system could also be a single cooling circuit comprising multiple compressors; or be multiple independent cooling circuits, each cooling circuit comprising at least one compressor and corresponding functional components for cooling.

What is claimed is:

1. A cooling appliance, comprising:

a plurality of thermally insulated storage chambers;

a cooling system for cooling the storage chambers, the cooling system operating in a first mode when it actively cools one or more of the chambers and a second mode when it does not actively cool one or more of the chambers; and an indication unit configured to show information regarding each of the storage chambers that is actively cooled by the cooling system when operating in the first mode;

wherein the indication unit comprises multiple indication portions respectively corresponding to one or more storage chambers and illumination elements for illuminating the corresponding indication portions; wherein only when one or more of the storage chambers is being actively cooled when the cooling system operates in the first mode, the luminance of the illumination element corresponding to each actively cooled storage chamber periodically and gradually changes between a lower limit value and an upper limit value.

2. The cooling appliance according to claim 1, wherein, the information is shown through characters, symbols, and optical and/or acoustic signals.

3. The cooling appliance according to claim 1, wherein, the multiple indication portions are sequentially arranged according to an arrangement sequence of the storage chambers.

4. The cooling appliance according to claim 1, further comprising:

multiple doors, wherein each of the doors is used to close or open at least one part of the corresponding storage chambers, and the indication unit is disposed on at least one door.

5. The cooling appliance according to claim 4, wherein, the indication unit is disposed on a front side of the door.

6. The cooling appliance according to claim 1, further comprising:

multiple doors for closing or opening the corresponding storage chambers, and each indication portion is disposed on the door of the storage chamber corresponding to the indication portion respectively.

7. The cooling appliance according to claim 1, further comprising:

a main display unit for displaying at least one set parameter of the cooling appliance, wherein the indication unit and the main display unit are separately disposed.

8. The cooling appliance according to claim 7, wherein, in the case that the multiple storage chambers are closed, when viewed from a front side of the cooling appliance, the main display unit is invisible, and the indication unit is visible.

9. The cooling appliance according to claim 1, further comprising:

a main display unit for setting at least one parameter of the cooling appliance, wherein the indication unit is integrated inside the main display unit.

10. An operation method of a cooling appliance, wherein the cooling appliance comprises multiple storage chambers and a cooling system for cooling the storage chambers, the method comprising:

determining which of the storage chambers is/are currently actively cooled by the cooling system; and indicating, by an indication unit which comprises multiple illumination elements, each of the illumination elements corresponding to at least one storage chamber, information of each of the storage chambers being actively cooled by the cooling system by periodically and gradually changing luminance of the illumination element corresponding to the storage chamber between a lower limit value and an upper limit value.

11. The method according to claim 10, wherein, the step of determining which of the storage chambers is/are being cooled by the cooling system comprises:

detecting the temperature of each storage chamber, and judging whether the obtained storage chamber temperature is falling; if yes, determining that the cooling system is cooling the storage chamber with the falling temperature.

12. The method according to claim 10, wherein, the cooling system comprises at least one valve for changing a cooling mode of the cooling system, and it is judged, by determining a position of the valve, which of the storage chambers is/are being cooled by the cooling system.

13. The method according to claim 1, wherein when one of the storage chambers is not cooled, the corresponding illumination element is either not activated or it luminance does not vary.

14. A cooling appliance, comprising:

at least one thermally insulated storage chamber;

a cooling system for cooling the at least one storage chamber and being operable in a first mode in which the storage chamber is actively cooled and a second mode in which the storage chamber is not actively cooled; and an indication unit configured to show information as to whether the storage chamber is being actively cooled by the cooling system when operating in the first mode;

wherein the indication unit comprises an indication portion corresponding to the at least one storage chamber and an illumination element for illuminating the indication portion.

15. The cooling appliance according to claim 14, wherein, the information is shown through characters, symbols, and optical and/or acoustic signals.

16. The cooling appliance according to claim 14, further comprising:

a door, wherein the door is used to close or open at least one part of the storage chamber, and the indication unit is disposed on the door.

17. The cooling appliance according to claim 16, wherein the indication unit is disposed on a front side of the door.

18. The cooling applicant according to claim 14, wherein only when the at least one storage chamber is being cooled, the luminance of the illumination element periodically and gradually changes between a lower limit value and an upper limit value.

* * * * *